United States Patent [19]

Wagner

[11] 4,300,675

[45] Nov. 17, 1981

[54] BOX FOR CIGARETTES, CIGARS AND THE LIKE SMOKING UNITS

[76] Inventor: Hans-Ruedi Wagner, 25 Woodale La., Santa Barbara, Calif. 93103

[21] Appl. No.: 218,130

[22] Filed: Dec. 19, 1980

Related U.S. Application Data

[63] Continuation-in-part of Ser. No. 140,773, Sep. 26, 1979, abandoned, which matured from PCT/CH79/00010, PCT filed Jan. 26, 1979, 102 (e) date Sep. 26, 1979.

[51] Int. Cl.[3] ..... B65D 85/10; B65D 85/12

[52] U.S. Cl. ..... 206/252; 206/45.13; 206/255; 206/267; 312/61; 220/345

[58] Field of Search ..... 206/252, 255, 256, 267, 206/250, 45.13; 220/345; 312/61

[56] References Cited

U.S. PATENT DOCUMENTS

| | | | |
|---|---|---|---|
| D. 29,056 | 7/1898 | Weiss | 206/256 |
| 736,268 | 8/1903 | Kline | 312/61 |
| 2,498,035 | 2/1950 | Esterow | 206/255 |
| 2,525,728 | 10/1950 | Sawer | 206/45.13 |
| 2,526,091 | 10/1950 | Slonneger | 220/345 |
| 2,589,593 | 3/1952 | Anderson et al. | 206/45.13 |
| 3,086,645 | 4/1963 | Yount | 206/45.13 |
| 4,082,386 | 4/1978 | Beasley, Jr. | 312/330 R |

FOREIGN PATENT DOCUMENTS

| | | | |
|---|---|---|---|
| 138635 | 8/1934 | Austria | 206/250 |
| 1042000 | 9/1966 | United Kingdom | 206/250 |

*Primary Examiner*—William T. Dixson, Jr.
*Attorney, Agent, or Firm*—Heinrich W. Herzfeld

[57] ABSTRACT

A box for cigarettes, cigars or the like smoking units comprises a box body having a longitudinally displaceable slide cover. A lifting hoop or stirrup of spring wire serves for lifting the smoking units at one end, while the cover has been partly removed. The wire hoop has two ends which are inserted in opposite side portions of the box body, and two legs which are depressed into corresponding grooves of the body by the cover when the latter is completely closed, as well as a cross portion which extends across the top face of the box body and which is raised, the legs adjacent the cross portion being biassed upwardly away from the box front face when the cover is partly slid away therefrom to expose the larger portion of the hoop.

1 Claim, 3 Drawing Figures

BOX FOR CIGARETTES, CIGARS AND THE LIKE SMOKING UNITS

EARLIER APPLICATIONS

This application is a continuation-in-part of my pending patent application Ser. No. 140,773 filed Sept. 26, 1979 now abandoned which matured from PCT/CH79/00010, PCT filed Jan. 26, 1979, 102(e) date Sept. 26, 1979.

BACKGROUND OF THE INVENTION

This invention relates to a box of cigarets, cigars and the like smoking units, for instance cigarillos, from which such units can be removed individually one at a time.

Known boxes of this kind usually contain one or several cigarets or the like placed closely side by side in a row or in several super-imposed rows, and it is troublesome to remove an individual cigaret therefrom. Known cigaret boxes permit the very end portion of one such cigaret to protrude from the cover, which cigaret must then be seized with the tips of two fingers at the protruding end portion, which might damage or dirty it.

In particular French patent No. 1,068,034 of RENÉ DUBOURG, published on June 22, 1954 provides for an upwardly tiltable bottom part which permits to tilt a number of pencils lying in a row with their sharpened ends in elevated position. While it is relatively easy to lift an individual pencil out of a row by pressing a finger tip against its point, it is more awkward to do the same in the case of cigarets, where pressure of a finger against the tip of a cigaret may deform the latter, it may also cause several cigarets to be lifted at the same time, whereby one or two may be dropped, and, in the case that the filter tip ends of the cigarets are elevated, pressing with the finger tip against the open filter at that end may also be unhygienic.

OBJECT AND SUMMARY OF THE INVENTION

It is an object of the invention to provide a box of the initially described type from which a cigaret or the like smoking unit can be removed more easily, permitting seizure of the unit away from its very end portions.

This is achieved in the case of a box according to the invention, which box comprises an elongated body, having longitudinal grooves disposed parallel to and adjacent one another, each destined for receiving a single smoking unit therein, a slide cover displaceable in the direction of the longitudinal axis of the body, and a lifting hoop (or stirrup) of spring wire, having a transverse hoop portion and two legs being provided with bent free ends which are inserted in pivot holes in the longitudinal lateral sides of an end portion of the body, the said body further having a transverse groove across the longitudinal grooves near the ends of the latter away from the pivot holes of the body, which transverse groove is deeper than said longitudinal grooves by at least as much depth as the wire of the said transverse hoop portion is thick, so as to receive the latter in said transverse groove in a position underneath the cigarets or the like smoking units positioned in said longitudinal grooves, when the cover is in closed position, while the free ends of the legs and the remainder of the legs are so bent relative to one another that the legs are sufficiently biassed as to lift the transverse hoop portion, and are inclined upwardly with the transverse portion of the hoop lifted above the region of the longitudinal grooves intersected by the transverse box groove and completely out of the latter, when the cover is correspondingly partially removed away from the front face of the box, exposing the region of the longitudinal grooves and the transverse groove therein. Thereby, the ends of cigarets or the like units resting on the transverse hoop portion are raised in an inclined position with their hoop-supported ends and middle portion completely out of the longitudinal grooves.

BRIEF DESCRIPTION OF THE DRAWING

Further details of the invention shall be explained in connection with the accompanying drawing in which.

DETAILED DESCRIPTION OF THE EMBODIMENT SHOWN IN DRAWING

Figure 1:
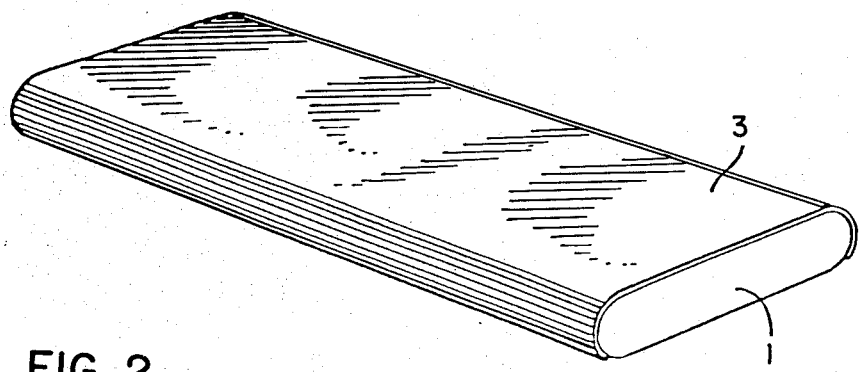
FIG. 1 shows in perspective view a preferred embodiment of the box according to the invention completely closed by means of the box cover.

The box for cigarets or the like smoking units shown in the drawing comprises a elongated box body 1 made of high quality wood or the like suitable material, which has longitudinal grooves 2 extending parallel with and next adjacent one another, which grooves are destined for receiving each a cigaret or the like smoking unit therein. The box also comprises a slide cover 3 displaceable longitudinally on the front face of box 1 and completely covering the latter when in closing position.

The cover 3 may be made from colored eloxated aluminum sheet. The box further comprises a lifting hoop (or stirrup) 4 of spring wire which has bent ends 4*a* which are inserted, in one of the end regions of the elongated body 1 in holes provided in the longitudinal sides of the body 1. The hoop 4 also has a transverse hoop portion 4*b* and the body 1 is provided with a corresponding transverse groove 5 which extends deeper than the bottoms of the longitudinal grooves by a distance which is at least as great as the thickness of the wire constituting the aforesaid transverse hoop portion, so that the latter can be completely embedded in the transverse groove underneath the bottom plane of the longitudinal box grooves when the slide cover 3 is completely slid over the front face of body 1. Legs 4*c* of the hoop 4 having their one ends connected with one another by the transverse hoop portion 4*c* and having their opposite free ends 4*a* bent away as mentioned above, extend in an upwardly inclined position away from ends 4*a*, when the cover 3 is completely slid away from and exposes the longitudinal grooves 2, covering only the portion of box 1 containing the holes in which free hoop ends 4*a* are inserted. In this upwardly inclined position of hoop legs 4*c*, the transverse hoop portion 4*b* is raised above the front face of body 1.

When the cover 3 is slid forward over the front face of box 1 to completely cover the latter, the depressed legs 4*c* are entered into corresponding longitudinal lateral grooves 6 in box body 1.

A recess 7 can be provided in the front face of box 1 outside the region of grooves 2 and is destined for receiving therein a cigar tip cutter or knife (not shown).

Figure 2:
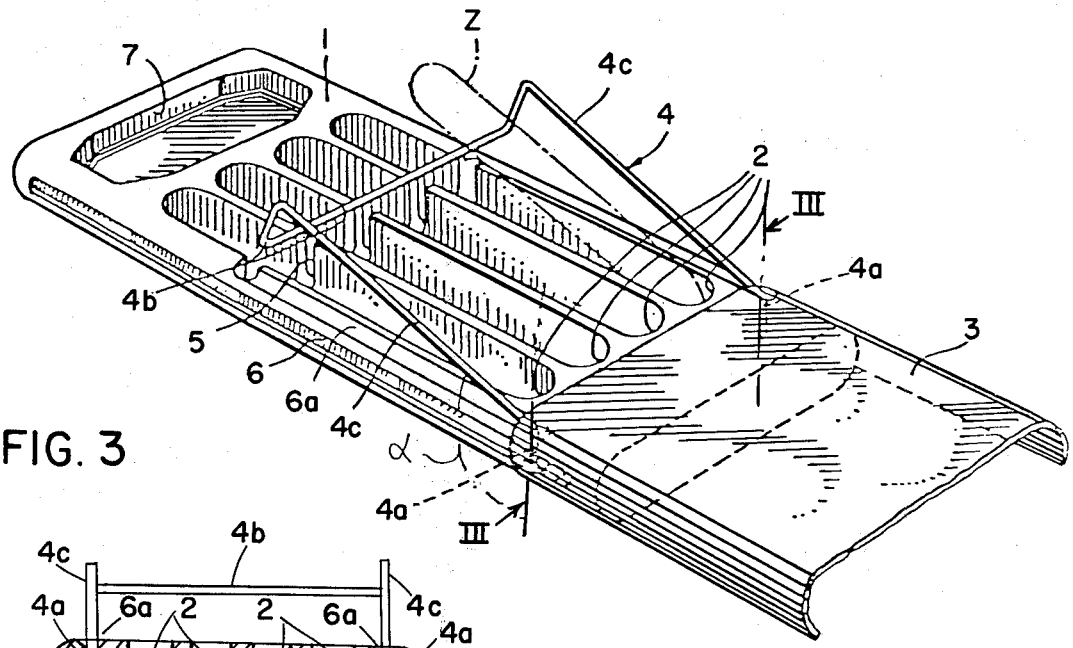
FIG. 2 shows in perspective view the same embodiment in open condition, with the cover slid away from and exposing the major portion of the front face of the box.
Figure 3:
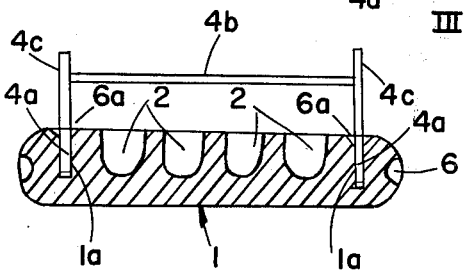
FIG. 3 is a cross-sectional view of the box body in a plane indicated by III—III in FIG. 2.

As shown in FIG. 2, the legs 4*c* form an obtuse angle $\alpha$ with the bent ends 4*a*, whereby, in undepressed condition as shown in FIG. 2 the legs 4c extend at an angle upwardly while the bent hoop ends 4a are held in a position vertical to the plane of the box body 1 in holes 1a of the latter body.

When depressed by the slide cover 3, the legs 4c rest in lateral grooves 6a in the top face of box body 1.

I claim:

1. A box for cigarets, cigars or the like smoking units comprising an elongated body, having longitudinal grooves disposed parallel to and adjacent one another, each destined for receiving a single smoking unit therein, a slide cover displaceable in the direction of the longitudinal axis of the body, and a lifting hoop (or stirrup) of spring wire, having a transverse hoop portion and two legs being provided with bent free ends which are inserted in pivot holes in the longitudinal lateral sides of an end portion of the body, the said body further having a transverse groove across the longitudinal grooves near the ends of the latter away from the pivot holes of the body, which transverse groove is deeper than said longitudinal grooves by at least as much depth as the wire of the said transverse hoop portion is thick, so as to receive the latter in said transverse groove in a position underneath the cigarets or the like smoking units positioned in said longitudinal grooves, when the cover is in closed position, while the free ends of the legs and the remainder of the legs are so bent relative to one another that the legs are sufficiently biassed as to lift the transverse hoop portion, and are inclined upwardly with the transverse portion of the hoop lifted above the region of the longitudinal grooves intersected by the transverse box groove and completely out of the latter, when the cover is correspondingly partially removed away from the front face of the box, exposing the region of said longitudinal grooves and said transverse groove therein.

* * * * *